US010550616B2

(12) United States Patent
Suarez Gonzalez

(10) Patent No.: US 10,550,616 B2
(45) Date of Patent: Feb. 4, 2020

(54) HINGE FOR DOORS

(71) Applicant: Yeray Suarez Gonzalez, Arucas (ES)

(72) Inventor: Yeray Suarez Gonzalez, Arucas (ES)

( * ) Notice: Subject to any disclaimer, the term of this patent is extended or adjusted under 35 U.S.C. 154(b) by 33 days.

(21) Appl. No.: 14/777,376

(22) PCT Filed: Mar. 17, 2014

(86) PCT No.: PCT/ES2014/070191

§ 371 (c)(1),
(2) Date: Sep. 15, 2015

(87) PCT Pub. No.: WO2014/147272

PCT Pub. Date: Sep. 25, 2014

(65) Prior Publication Data

US 2016/0047152 A1 Feb. 18, 2016

(30) Foreign Application Priority Data

Mar. 19, 2013 (ES) ..... 201330392

(51) Int. Cl.
*E05D 7/081* (2006.01)
*E05D 7/08* (2006.01)
(Continued)

(52) U.S. Cl.
CPC ..... *E05D 7/081* (2013.01); *E05D 1/00* (2013.01); *E05D 5/046* (2013.01); *E05D 7/08* (2013.01); *E05D 5/04* (2013.01); *E05D 9/005* (2013.01); *E05Y 2201/628* (2013.01); *E05Y 2600/626* (2013.01); *E05Y 2900/20* (2013.01)

(58) Field of Classification Search
CPC . Y10T 16/552; Y10T 16/5525; Y10T 16/554; Y10T 16/559; Y10T 16/534; E05Y 2201/628; E05Y 2600/626; E05Y 2900/20; E05D 7/081; E05D 7/08; E05D 7/01; E05D 1/00; E05D 5/046; E05D 5/0246;
(Continued)

(56) References Cited

U.S. PATENT DOCUMENTS 2,191,900 A * 2/1940 Pariot ..... E05D 7/081 16/253
4,620,392 A * 11/1986 Kerpers et al. ..... E05D 7/1011 49/382
(Continued)

FOREIGN PATENT DOCUMENTS

ES 2308741 T3 12/2008
JP 2000160912 A 6/2000

*Primary Examiner* — William L Miller
(74) *Attorney, Agent, or Firm* — Sanchelima & Associates, P.A.; Jesus Sanchelima; Christian Sanchelima

(57) ABSTRACT

Door hinge, configured by a base body (3) having a flat surface (4), to be joined, by means of an adhesive or screws, to the upper and lower base of the piece of furniture, and a circular cavity (8) to receive, fitted therein, the lower or upper edge end (2*a*) of the door, either directly through insertion of a projection (9) of the door, dimensioned for that purpose, or through a rotation cylindrical part (11). The rotation cylindrical part (11) is an independent piece or it is joined integrally to the upper or lower edges end (2*a*) of the door (2) or it is part of the door itself. The edge of the base body (3) of the hinge (1) is provided with a recess (13) suitable for receiving, fitted therein, a projection (14) of the door in a matching position, intended to secure closing thereof.

8 Claims, 3 Drawing Sheets

(51) Int. Cl.
*E05D 1/00* (2006.01)
*E05D 5/04* (2006.01)
*E05D 9/00* (2006.01)

(58) Field of Classification Search
CPC .. E05D 5/04; E05D 9/005; E05D 9/00; E05D 5/024; E05D 9/0056; E06B 3/80
USPC .... 16/378, 379, 382, 388, 252; 49/398, 388, 49/397; 160/DIG. 8
See application file for complete search history.

(56) References Cited

U.S. PATENT DOCUMENTS

| | | | | |
|---|---|---|---|---|
| 5,613,276 | A * | 3/1997 | Franz | E05D 5/024 16/229 |
| 7,707,776 | B2 * | 5/2010 | Weissofner et al. | E05D 5/024 49/388 |
| 2003/0213103 | A1 | 11/2003 | Cameron | |
| 2007/0246945 | A1 | 10/2007 | Chiang | |
| 2013/0081331 | A1 * | 4/2013 | Vullings et al. | E05D 7/00 49/388 |
| 2013/0111818 | A1 * | 5/2013 | Yagi | E05D 1/06 49/397 |

* cited by examiner

HINGE FOR DOORS

BACKGROUND OF THE INVENTION

1. Object of the Invention

The invention, as it is expressed in the title of the present specification, refers to a door hinge which, as well as featuring the usual characteristics of the function it is intended to, is provided with several advantages and novel characteristics which will be described in further detail below and which represent an improved alternative to the systems currently known in the art for the same purpose.

Moreover, the object of the invention is focused on a hinge of the type used to achieve a hinged attachment of doors to the setting they are installed in, being this hinge particularly intended for doors for cupboards and furniture in general; having the special feature of being designed with an extremely simple structural configuration, the purpose of which is to provide a much easier installation and removal of said type of doors without requiring the use of any type of tools, and thereby enabling the replacement or exchange of the furniture front panels at will, for example, to change the colour or the designs or images those doors may incorporate.

2. Field of the Invention

The present invention relates to the manufacture of iron fittings and hardware for furniture, and more particularly hinges.

3. Background of the Invention

Several types of hinges are known in the art, many of them specifically intended for furniture doors. However, there are hinges with features similar to those present in the hinge described herein and according to what is claimed herein.

SUMMARY OF THE INVENTION

Thus, the door hinge disclosed in the present application, is configured as a novel device providing for easy installation and removal from doors, for which it is intended, and can be implemented without requiring the use of any tools; being the characteristic details that make this possible and distinguishable duly included in the final claims accompanying the present description thereof.

The invention is configured from a base body which is fixed, by means of an adhesive or screws, both to the upper and to the lower part of the piece of furniture, fastened in both cases to an end of the opening, depending on the side towards which the door is to be opened, and the base is provided with a hollow cylinder in which an end of the door upper and lower edge is fitted.

It should be noted that the attachment can be carried out either directly, through the insertion within a cavity of a notched section made respectively in said upper and lower edges for that purpose, or by means of an auxiliary rotation cylindrical part which improves the sliding between both sections, providing an easier rotation of the door which is fitted in the cylindrical cavity and in which, in turn, the door edges can be fitted in by a notched section provided therein for that purpose.

Optionally, said rotation cylindrical part can be integral to the edges of the door or, directly, be a part thereof.

In any case, it is important to point out that the door must be of a material such as plastic, methacrylate or any other similar material with a certain grade of flexibility, and further featuring little thickness, just enough to allow said flexibility and thus enable the coupling thereof to the lower and upper hinges.

Additionally, the edge of the hinge base body may feature a recess intended to receive a press-fit projection provided in the door in matching configuration, as a retention system so as to secure closing thereof.

Thus, the way the door couples to the hinge is as follows: once the two hinge bases are placed respectively in the upper and lower section of the piece of furniture, bonded with double-coated adhesive tape, or fixed by means of a screw, the door is fitted in the housing therefor by simply bending it. In order to do that, first the upper or lower section of the door edge will be fitted in the corresponding base and, by slightly bending the panel making up said door, so that it acquires a lower height upon bending, the attachment of the opposite side will be carried out, so there is no need of using any type of tools.

For the door removal, the operation is the same, but reversely. First, the panel is bent so as to release the attachment from the lower or upper section, and after that the opposite attachment is easily released.

Preferably, the base body and, if appropriate the rotation cylindrical part, are made of plastic or methacrylate, and, when the door incorporates the rotation cylindrical part as a built-in part thereof, the door will be made of injected plastic, although that is not to be understood as a limitation, since, as it has been pointed out said cylindrical part could be integral to, for instance bonded, to the door edges.

In that case, the door could be made of any material, plastic, wood, cardboard, etc., which is the same or different to that of the base part and the rotation cylindrical part, provided that it allows certain grade of flexibility.

The above described hinge represents, therefore, an innovative structure featuring structural and constitutive characteristics unknown so far for the purpose it is intended to, reasons which, together with its practical usefulness, grant enough basis to obtain the exclusiveness privilege applied for.

BRIEF DESCRIPTION OF THE DRAWINGS

To implement the present description and in order to provide a better understanding of the characteristics of the invention, a set of layouts is attached as an integral part thereof, with an illustrative but not limitative purpose, which represents the following.

DETAILED DESCRIPTION OF THE EMBODIMENTS OF THE INVENTION

Figure 1:
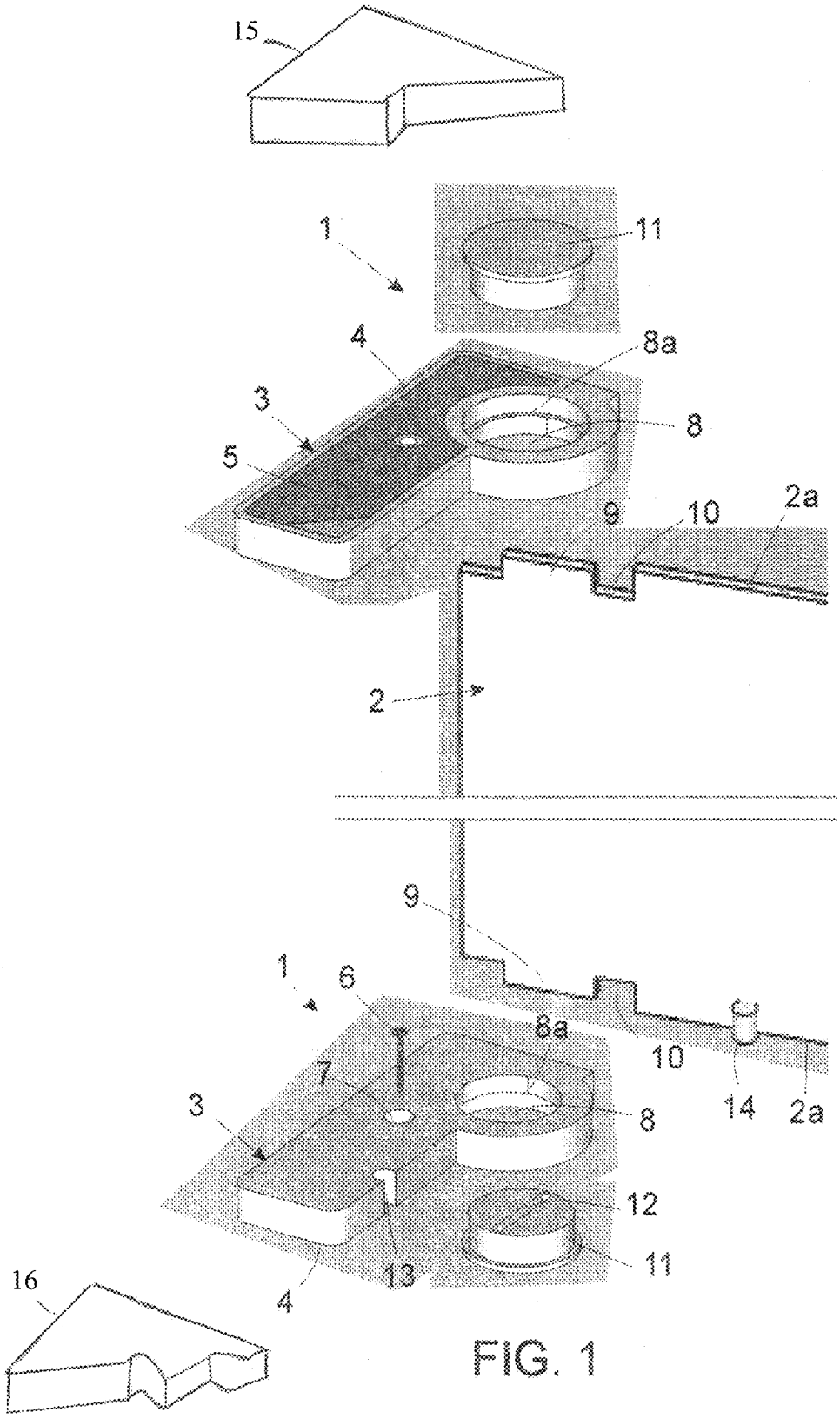
FIG. 1 shows an exploded isometric view of the door hinge object of the invention, in an embodiment example thereof, wherein an independent rotation cylindrical part is coupled to the base cylindrical cavity, showing the different parts and elements it comprises, as well as the configuration and arrangement of said parts and elements in both the upper and lower section of the door, and having two options for the base fixing, by means of an adhesive or screws.

In view of the aforementioned figures, and according to the reference numbering chosen, it can be observed in them a non-limiting example of the door hinge, object of the invention, which comprises parts and elements indicated and described in further detail below.

Thus, as it can be observed in said figures, the hinge (1), designed to couple both in the lower and in the upper section of the door (2) for which it is intended, is configured from a base body (3) featuring a flat surface (4), susceptible to be integrally joined, by means of an adhesive (5) or a screw (6) inserted in an orifice (7) provided therein for that purpose, to the upper and lower bases (15) and (16) of the piece of furniture (not shown) to which the door is coupled (2), and where the existence of a circular cavity (8) is contemplated, being said cavity suitable for receiving, fitted therein, the upper or lower edge end (2*a*) of the door.

Obviously, as it can be observed in FIG. 1, the upper edge end (2*a*) of the door will be fitted in the cylindrical cavity (8) of the hinge (1) fixed to the upper base of the piece of furniture, and the lower edge (2*a*) of the door will be fitted in the cylindrical cavity (8) of the hinge (1) fixed to the lower base of the piece of furniture and the base bodies (3) of both hinges (1) will be fixed to the upper and lower section of the piece of furniture fastened to the previous edge thereof.

Figure 2:
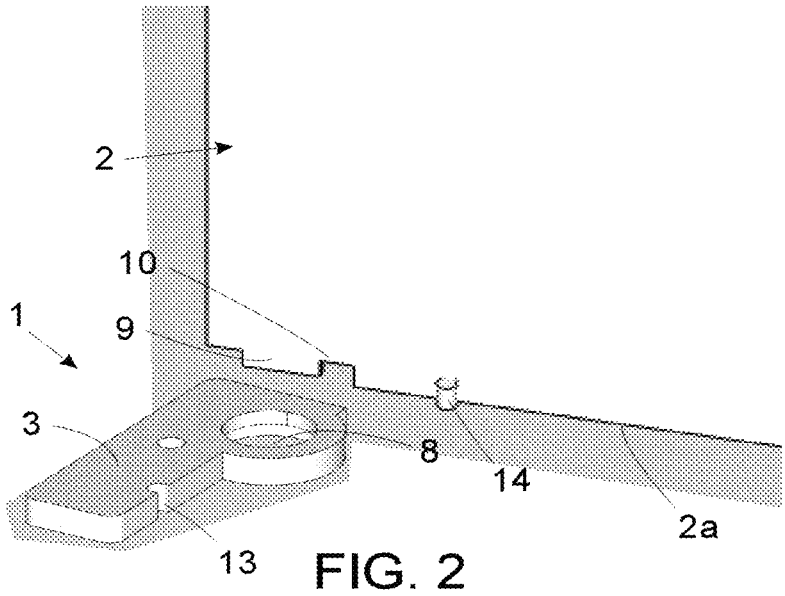
FIG. 2 shows an exploded isometric representation another example of the hinge object of the invention, in this case being provided for the direct attachment of the door at the base, without the rotation cylindrical part.

In an example of an embodiment, shown in FIG. 2, said attachment of the upper/lower edge end (2*a*) of the door (2) in the circular cavity (8) is performed directly by inserting in said cavity a projection (9), determined by the existence of a stepped notched section (10) made respectively in said upper and lower end edges of the door, which is precisely dimensioned to fit in tightly in the circular cavity (8) and, upon rotation therein, to enable rotation of the door (2).

Preferably, however, the attachment of the upper/lower edge end (2*a*) of the door (2) in the circular cavity (8) is carried out by means of a rotation cylindrical part (11) which is fastened inside of the cylindrical cavity (8) and improves sliding between both parts.

In an embodiment example, the rotation cylindrical part (11), shown in FIG. 1, is an independent part which couples to the circular cavity (8) of the base body (3) of the hinge, so that it freely rotates therein, and it comprises a groove (12) that is accessible through its facing area, so that it is suitable to have the projection (9) of the upper and lower edges (2*a*) of the door (2) fitted therein and, thus, facilitate the rotation thereof.

Figure 3:
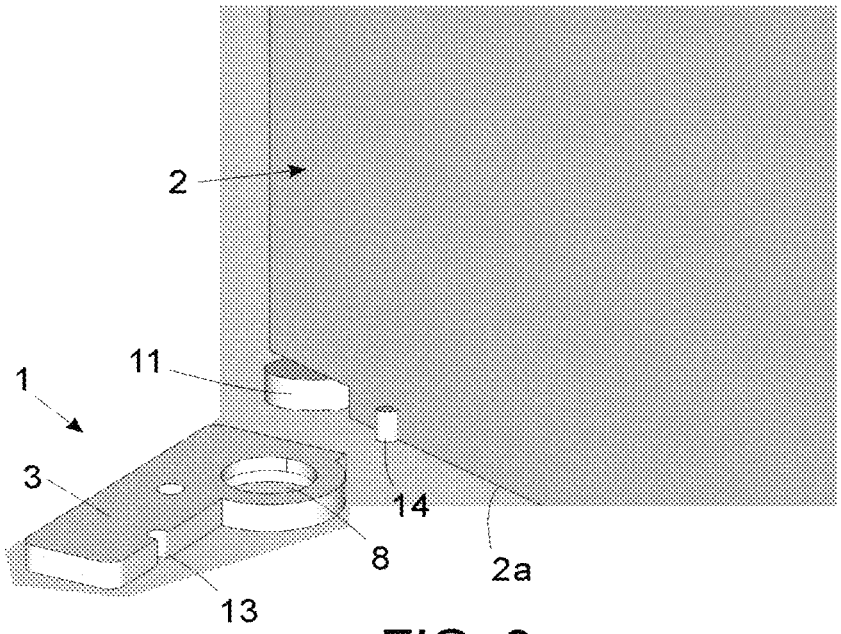
FIG. 3 shows an exploded isometric representation of the hinge according to the invention, in this case in an example with the rotation cylindrical part fixed to the door.
Figure 3A:
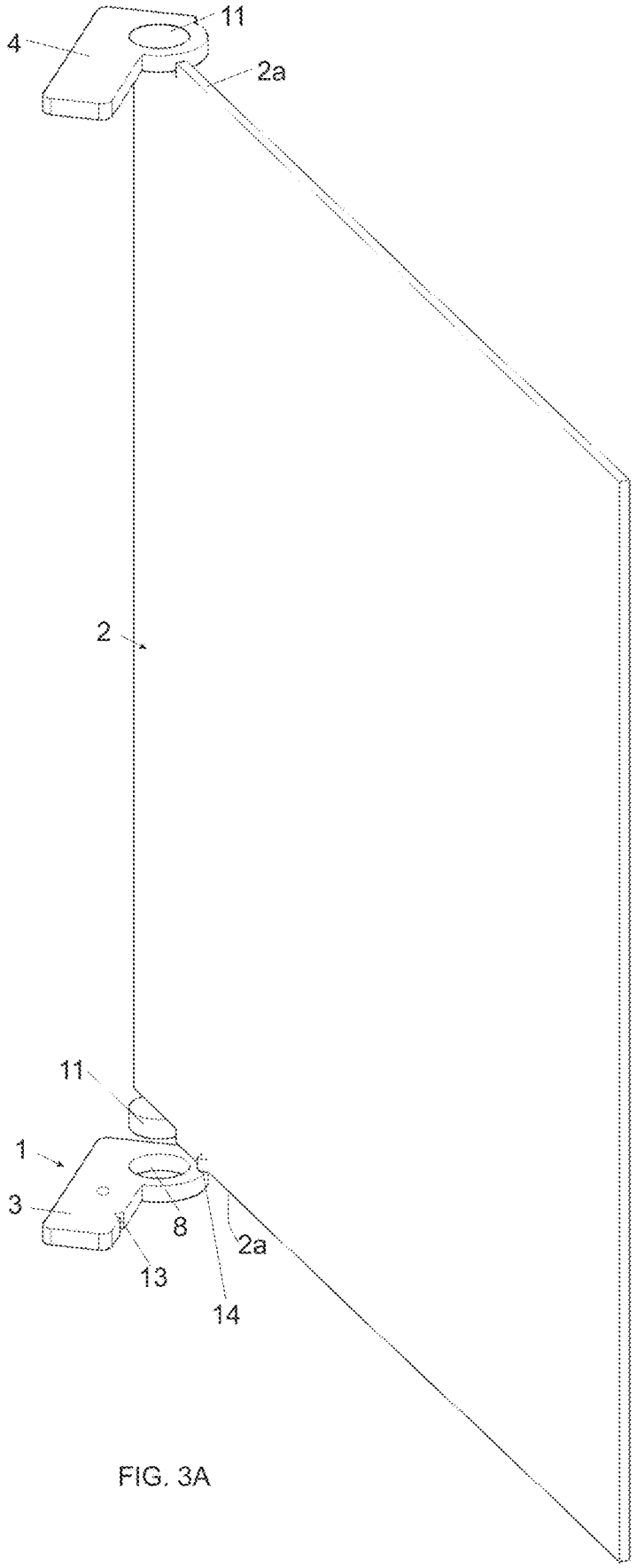
FIG. 3A shows an isometric view of the wall with cylindrical part (11) at the upper and lower ends.

Alternatively, the rotation cylindrical part (11) is integrally joined, by means of any fastening system, for example bonded, to the lower and upper edges end (2*a*) of the door (2), as it is sown in FIG. 3.

Finally, in another possible embodiment, there is a possibility contemplated for said cylindrical part (11) to be located in the upper and lower edges end (2*a*) of the door (2), being a part of the piece itself which makes up said door.

Additionally, and in any of the embodiments described, the circular cavity (8) features an interior step (8*a*) which prevents the circular part (11) to come out of the housing thereof, when it is mounted in the upper section of the piece of furniture.

Furthermore, also additionally, there is a possibility contemplated of having a recess (13) provided in the edge of the base body (3) of the hinge (1), intended to receive a projection (14) provided in the door, which has been placed next to the edge (2*a*) thereof in a matching position when closing the door, acting as a retention system to secure closing thereof upon pressure-fitting said projection (14) in said recess (13).

As it has been stated above, to allow assembling the door in the hinges (1) described, the door (2) is made of a material with a certain grade of flexibility, such as plastic, methacrylate or a similar material, and further featuring little thickness so as to bend it slightly and enable the coupling thereof to the upper and lower hinges.

Having sufficiently described the nature of the present invention, as well as the way it should be put into practice, it is considered unnecessary to describe it any further for a person skilled in the art to understand the scope thereof and the advantages that can be derived from it, stating that under the essential content of the present invention, it can be put into practice following other embodiments differing in detail from that indicated as an example, and which will lie under the protection scope procured, provided it does not alter, change or modify the fundamental principle thereof.

What is claimed is:

1. A hinge for a furniture door comprising: the door (2) being made of a flexible material and having upper and lower edges (2*a*); a base body (3) having a flat surface (4), joined to a respective upper and lower base (15) and (16) of a piece of furniture to which the door (2) is coupled, and wherein a circular cavity (8) is formed in the base body (3); a screw for joining said base body (3) to the upper and lower base (15) and (16); and wherein the upper and lower edges (2*a*) each include a projection (9) formed by an adjacent stepped notched section (10) in said upper and lower edges, and wherein the projection (9) is tightly fitted in the respective circular cavity (8).

2. The hinge, according to claim 1, wherein said screw (6) is inserted in an orifice (7) provided in said base body (3).

3. The hinge, according claim 1, wherein a rotation part (11) is fastened within the circular cavity (8).

4. The hinge, according to claim 3, wherein the rotation part (11) is an independent part that couples to the circular cavity (8) of the base body (3) of the hinge, so that it rotates freely inside it, and comprises a groove (12) having the projection (9) of the upper and lower edges (2*a*) of the door (2) fitted therein.

5. The hinge, according to claim 1, wherein the base body (3) is provided with a recess (13) which receives via a press-fit a projection (14) provided in the door (2), intended to secure closing thereof.

6. A hinge for a furniture door comprising: the door (2) being made of a flexible material and having upper and lower edges (2*a*); a base body (3) having a flat surface (4), joined to a respective upper and lower base (15) and (16) of a piece of furniture to which the door (2) is coupled, and wherein a circular cavity (8) is formed in the base body (3); an adhesive for joining said base body (3) to the upper and lower base (15) and (16); and wherein the upper and lower edges (2*a*) each include a projection (9) formed by an adjacent stepped notched section (10) in said upper and lower edges, and wherein the projection (9) is tightly fitted in the respective circular cavity (8).

7. The hinge, according claim 6, wherein a rotation part (11) is fastened within the circular cavity (8).

8. The hinge, according to claim 6, wherein the rotation part (11) is an independent part that couples to the circular cavity (8) of the base body (3) of the hinge, so that it rotates freely inside it, and comprises a groove (12) having the projection (9) of the upper and lower edges (2*a*) of the door (2) fitted therein.

* * * * *